US006200425B1

(12) United States Patent
Pellinen

(10) Patent No.: US 6,200,425 B1
(45) Date of Patent: Mar. 13, 2001

(54) ARRANGEMENT IN TISSUE MACHINE

(75) Inventor: Kari Pellinen, Säynätsalo (FI)

(73) Assignee: Neles Paper Automation Oy, Tampere (FI)

( * ) Notice: Subject to any disclaimer, the term of this patent is extended or adjusted under 35 U.S.C. 154(b) by 0 days.

(21) Appl. No.: 09/303,619

(22) Filed: Apr. 20, 1999

(51) Int. Cl.[7] ..... D21F 11/00; D21F 5/00; D21J 3/00

(52) U.S. Cl. ..... 162/207; 162/206; 162/289; 162/290

(58) Field of Search ..... 162/206, 207, 162/289, 290, 359.1, 363, 361

(56) References Cited

U.S. PATENT DOCUMENTS 3,560,333 * 2/1971 Douglas et al. ..... 162/206

FOREIGN PATENT DOCUMENTS 197 48 708 A1 * 5/1998 (DE) .

* cited by examiner

*Primary Examiner*—Stanley S. Silverman
*Assistant Examiner*—Dionne A. Walls
(74) *Attorney, Agent, or Firm*—Alston & Bird LLP

(57) ABSTRACT

In a tissue machine, a roll is arranged to press a paper web against a Yankee cylinder. A steam box is arranged in connection with the roll. A steaming area of the steam box is arranged against the paper web substantially above the horizontal center line of the roll.

6 Claims, 1 Drawing Sheet

ARRANGEMENT IN TISSUE MACHINE

The invention relates to an arrangement in a tissue machine, which arrangement comprises a Yankee cylinder, a roll and a steam box having a steaming area, whereby a paper web is formed in the tissue machine and the roll is arranged to press the web against the Yankee cylinder.

When tissue paper is manufactured by a tissue machine, paper stock is first fed from a headbox onto a wire to form a web. The web proceeds with the wire through a nip formed by the roll, for instance a suction press roll, and a Yankee cylinder for drying into a drying section formed by the Yankee cylinder and a hood, where the web is typically dried to a dry solids content of about 90 to 95%.

In connection with the suction press roll there is often arranged a steam box, which feeds steam on the web and wire on the suction press roll. When condensing, the steam raises the temperature of the web and the wire, which in turn reduces the viscosity of the water on the web, i.e. increases the fluidity of water. Thus the water drains more readily off the web and further from the wire, and the dry solids content of the web increases at the nip, which improves the drying result to be achieved. By means of the steam box the capacity of the machine's drying section can thus be increased.

Figure 1:
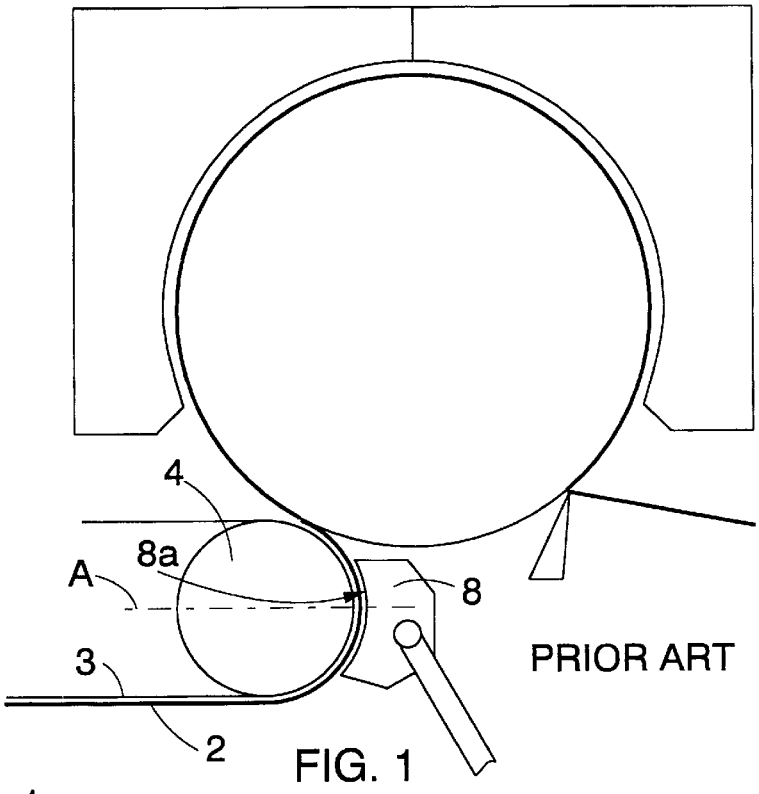

FIG. 1 illustrates a press section and a drying section of a prior art tissue machine. In accordance with the prior art, a steam box 8 is arranged on a suction press roll 4 substantially in the horizontal center line A of the suction press roll or below the center line A such that a paper web 2 and a wire 3 between the paper web and the suction press roll 4 run between said steam box 8 and the roll 4. When the web turns round the suction press roll 4, by the effect of centrifugal force the web 2 releases pulp splashes which hit and stick to the steam box 8 arranged at a distance from the web and to the steaming area 8*a* thereof. Pulp splashes foul the steaming area and block the nozzles located in that area. It becomes more difficult for the steam to pass from the steam box to the web, and in the worst case it may be prevented completely. Then the steam treatment of the web will change and the temperature or the dry solids content of the web will no longer correspond to design, which will have an adverse effect on the operation of the entire drying section. Gradually the amount of dirt accumulated in the steam box increases to the extent that dirt drips or drifts along with the steam to be blown onto the web. As a result, a web break occurs, which causes considerable costs.

The object of the present invention is to provide an arrangement which can eliminate at least some of the above drawbacks.

The arrangement in accordance with the invention is characterized in that the steam box is arranged on the roll such that the steaming area of the steam box is arranged against the web substantially above the horizontal center line of the roll.

The basic idea of the invention is that the steam box is arranged in connection with the roll arranged in the Yankee cylinder of the tissue machine, the steaming area of the steam box being arranged above the horizontal center line of the roll, whereby outward-flying pulp splashes do not substantially enter the steaming area of the steam box. The idea of one preferred embodiment is that a splash surface is arranged to extend from the lower edge of the steam box steaming area. The idea of one preferred embodiment is that the splash surface is arranged outside the web's outermost point in connection with the roll. The idea of a third preferred embodiment is that the splash surface is formed concave.

The invention has an advantage that pulp splashes, which would foul the steaming area and impede the operation of the steam box and of the entire drying section, will not fly off the web to the steaming area of the steam box. A further advantage can be achieved that the pulp splashes flying off the web will not fall or otherwise drift from the steam box back onto the web surface giving rise to a web break.

Figure 2:
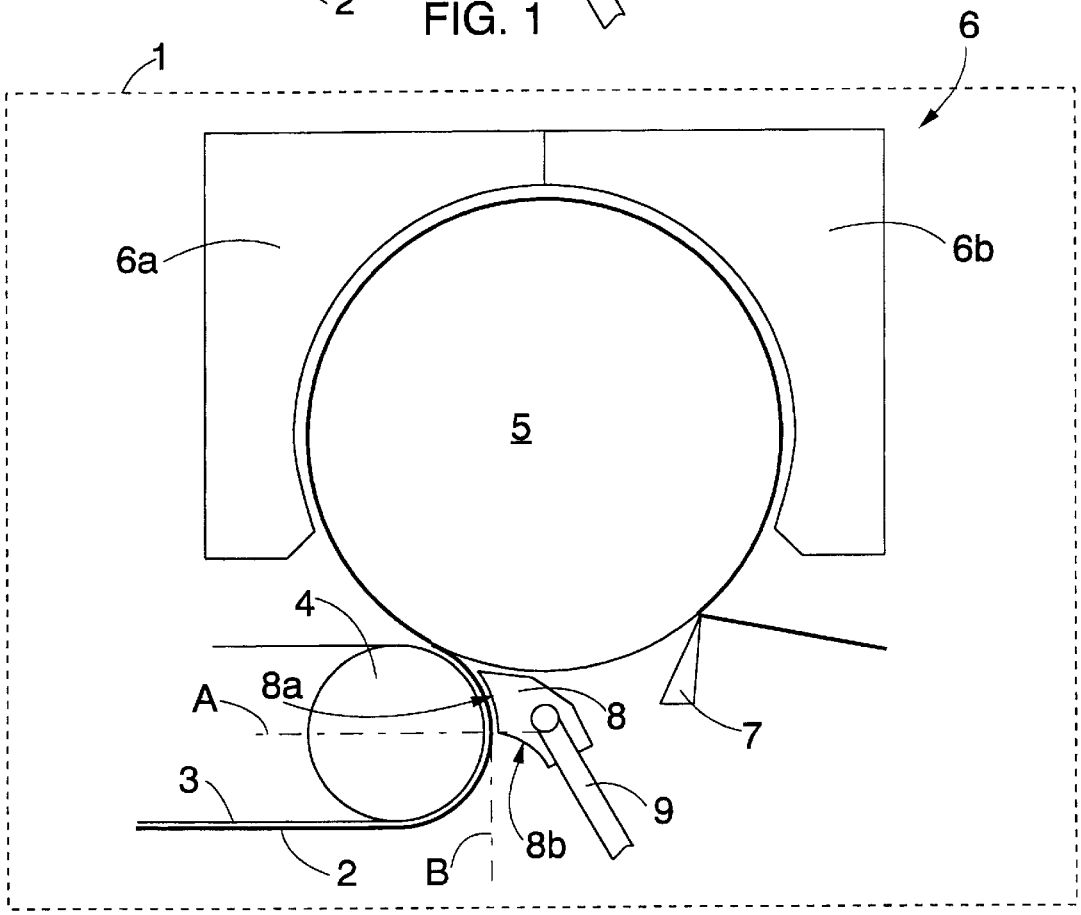

The invention will be described in greater detail in the attached drawing, wherein FIG. 1 is a schematic side view of a press and drying section of a prior art tissue machine and FIG. 2 is a schematic side view of one arrangement in accordance with the invention.

FIG. 2 shows a tissue machine 1 depicted schematically with a broken line. The tissue machine 1 comprises a headbox, wherefrom stock is fed into a former, where a paper web 2 is formed. Said means are quite obvious to a person skilled in the art, so for the sake of clarity they are not depicted in the attached drawing.

The formed web 2 is passed to a press section and a drying section, where the web 2 is dried typically to a dry solids content of about 90 to 95%. The web 2 is passed to the press and drying section below the wire 3 and is pressed with a roll of the press and drying section, most preferably with a suction press roll 4, against a Yankee cylinder 5 whereto the web 2 adheres. In the nip between the Yankee cylinder 5 and the suction press roll 4, most of the water in the web 2 is removed. Vacuum, the main function of which is to hold the web 2 against the roll, is arranged inside the suction press roll 4. A hood 6 is arranged around the Yankee cylinder 5, the hood typically comprising at least two parts 6*a* and 6*b*. By means of the hood 6, hot air is blown against the web 2. The Yankee cylinder 5 and the hood 6 dry the web 2 to a dry solids content, which is typically about 90% or more. The web 2 is detached from the surface of the Yankee cylinder 5 with a doctor blade 7. Thereafter, the web 2 passes onto a reel of the tissue machine 1. For the sake of clarity, parts of the tissue machine 1 subsequent to the drying section have been omitted in the attached drawing.

In connection with the suction press roll 4, there is arranged a steam box 8, which is supported to the body of the tissue machine 1 with support means 9. By means of the support means 9 the steam box 8 can be easily shifted further away from the suction press roll 4, for instance, if required by maintenance operations. It must be noted in this connection that the proportions of the devices and components depicted in the figure are not necessarily correct, for instance, the suction press roll 4 is typically substantially smaller in comparison with the Yankee cylinder 5. The steam box 8 comprises the steaming area 8*a*, where steam nozzles are arranged, through which nozzles steam is supplied from the steam box 8 against the web 2, the wire 3 and the suction press roll 4 in a manner known per se. The steam nozzles of the steaming area 8*a* are typically distributed in three zones in the direction of the web's 2 motion, of which zones the first in the direction of the web's 2 motion prevents cold air from passing into a slot between the steam box 8 and the suction press roll 4 and further into the web 2. Steam supplied through the nozzles in the middle zone heats the web 2 and the wire 3. The last zone in the direction of motion, which is located closest to the Yankee cylinder 5, comprises adjustable nozzles by which the temperature and dry solids content of the web 2 can be adjusted. By means of the steam box 8, it is possible to improve the drying capacity of the drying section and at the same time to increase the overall capacity of the paper machine 1. The steam discharged from the steam box 8 absorbs into the paper web 2, the wire 3 and slightly into the suction press roll 4. The vacuum prevailing in the suction press roll 4 is arranged such that steam will not unnecessarily get into the roll 4.

In the transverse direction of the machine the steam box 8 can be divided into zones having a typical length of about 150 to 330 mm. The amount of steam flowing into the zones can be adjusted either manually or automatically, for instance, controlled by a moisture meter arranged in connection with the reel. By the amount of steam flowing into the zones it is possible to influence the moisture profile of the web and the shape thereof. The zone length is selected to comply with the control need of the moisture profile in the machine in question.

The steaming area 8*a* of the steam box 8 is arranged above the horizontal center line A of the suction press roll 4. Then the pulp splashes detaching from the web 2 by the effect of centrifugal force will not substantially hit the steaming area 8*a*, since most of said pulp splashes detach from the web 2 when centrifugal force starts effecting at the beginning of the web 2 turn, i.e. below the horizontal center line A of the suction press roll. The steam box 8 further comprises the splash surface 8*b* which starts from the lower edge of the steaming area 8*a* and which the pulp splashes mainly hit. The splash surface 8*b* is most preferably concave, whereby the pulp splashes hitting the guard will mainly not fly back onto the web 2. Further, the splash surface 8*b* is most preferably arranged substantially outside the web's 2 outermost line B in the suction press roll 4, whereby the pulp splashes adhering to the splash surface 8*b* will not fall onto the web 2 when detaching from the splash surface 8*b*. Thus the pulp splashes cannot cause a web break.

The drawing and the specification relating thereto are only intended to illustrate the inventive idea. The details of the invention may vary within the scope of the claims. So the roll, which presses the paper web 2 against the Yankee cylinder 5, is most preferably a suction press roll 4, but it can also be any roll suitable for the use.

What is claimed is:

1. An arrangement in a tissue machine, which arrangement comprises a Yankee cylinder, a roll and a steam box having a steaming area, whereby a paper web is formed in the tissue machine, the roll is arranged to press the web against the Yankee cylinder, the steam box is arranged about the roll such that the steaming area of the steam box is adjacent to the web and is substantially above the horizontal center line of the roll, and the steaming area is configured to direct steam only toward the roll and directly at the web.

2. An arrangement as claimed in claim 1, wherein the steam box further comprises a splash surface, and the steam box is arranged on the roll such that at least most of the pulp splashes detaching from the web hit the splash surface.

3. An arrangement as claimed in claim 1, wherein the roll is a suction press roll.

4. An arrangement as claimed in claim 2, wherein the splash surface is arranged substantially outside the web's outermost line in the roll.

5. An arrangement as claimed in claim 4, wherein the splash surface is concave.

6. An arrangement as claimed in claim 2, wherein the splash surface is concave.

* * * * *